US006679650B2

(12) United States Patent
Britt et al.

(10) Patent No.: US 6,679,650 B2
(45) Date of Patent: Jan. 20, 2004

(54) PAVEMENT MARKING SYSTEM

(75) Inventors: Jerry Britt, Wesson, MS (US); Darrell Thompson, Pearl, MS (US)

(73) Assignee: Ennis Paint, Inc., Ennis, TX (US)

( * ) Notice: Subject to any disclaimer, the term of this patent is extended or adjusted under 35 U.S.C. 154(b) by 47 days.

(21) Appl. No.: 10/074,724

(22) Filed: Feb. 12, 2002

(65) Prior Publication Data

US 2003/0156901 A1 Aug. 21, 2003

(51) Int. Cl.[7] ..... F21V 7/22

(52) U.S. Cl. ..... 404/14; 404/12; 427/136; 427/137; 523/172

(58) Field of Search ..... 404/12, 14, 17, 404/75; 359/551; 427/136, 137; 428/120; 523/172

(56) References Cited

U.S. PATENT DOCUMENTS 4,713,404 A * 12/1987 Cavitt ..... 523/172
5,511,896 A * 4/1996 Marcato ..... 404/72
5,536,569 A * 7/1996 Lasch et al. ..... 428/328
5,928,716 A * 7/1999 Finley ..... 427/137
6,020,073 A * 2/2000 Wilson, Sr. ..... 428/489
6,107,367 A * 8/2000 Lazarus et al. ..... 523/172
6,116,814 A * 9/2000 Dietrichson ..... 404/94
6,247,818 B1 * 6/2001 Hedblom et al. ..... 359/540
6,365,262 B1 * 4/2002 Hedblom et al. ..... 428/143
6,414,606 B1 * 7/2002 Yujiri et al. ..... 340/901
6,479,132 B2 * 11/2002 Hedblom et al. ..... 428/143

* cited by examiner

*Primary Examiner*—Gary S. Hartmann
(74) *Attorney, Agent, or Firm*—Richard J. Hammond

(57) ABSTRACT

The present invention is directed to an improved thermoplastic pavement marking composition system that comprises a pavement surface that is light in color (white or off-white). A first marking stripe is applied and adheres to the top of the pavement surface. This first marking stripe has a thickness of at least about 40 mils to about 110 mils, and comprises a solidified thermoplastic resin composition. The solidified resin composition comprising a black pigment. A second marking stripe is applied and adheres to the surface of the first marking stripe, the second marking stripe having a thickness of at least 40 mils to about 750 mils or more. It is narrower than said first marking stripe and also comprises a solidified thermoplastic resin composition. The thermoplastic resin composition of the second marking stripe is comprised of a pigment that visibly contrasts with the first marking stripe. Because of the high contrast in color between the two stripes and the light colored pavement surface, the markings are highly visible in daytime conditions. Additionally, because of the thickness of each of the stripes as well as the combined thickness of the stripes, the marked pavement system is highly visible during periods of rain.

13 Claims, 2 Drawing Sheets

PAVEMENT MARKING SYSTEM

FIELD OF INVENTION

The present invention relates to a pavement marking system comprising a pavement surface and, adhered to the pavement surface are multiple layers of marking stripes comprising a first marking stripe comprising a solidified thermoplastic resin comprising a black pigment and, adhered to said first marking stripe, a second marking stripe comprising a thermoplastic resin comprising a pigment that visibly contrast with the first marking stripe. More particularly, the present invention relates to a durable pavement marking system comprising a pavement surface and, adhered to the pavement surface multiple layers of marking stripes comprising a first marking stripe that is from about 40 mils to about 110 mils thick comprising a solidified thermoplastic resin comprising a black pigment and, adhered to said first marking stripe, a second marking stripe that is from about 40 mils to about 750 mils thick comprising a thermoplastic resin comprising a pigment that visibly contrasts with the first marking stripe. Because of the color contrast and the thickness of the first and the second marking stripe, the pavement marking system remains highly visible during daylight hours and in rainy periods.

BACKGROUND OF THE INVENTION

Traffic marking paints for use on pavement, such as road surfaces, are important elements in modern traffic direction and control. They have been used, for example, in the form of arrows and lane dividers, as parking lot striping, to designate special areas, e.g., handicapped parking, and the like and are typically applied directly to the pavement surface. These paints are subject to a variety of factors that require their reapplication. For example, abrasion from high traffic volume can result in frequent reapplication of the traffic markings. Weathering, i.e., rain or snow, and high and low ambient temperature effects can melt, crack or decompose the traffic marking material rendering it ineffective for the purpose intended.

In addition to the factors associated with durability and environmental stability, these paints also require rapid drying rates, since traffic disruption is an important consideration in the selection of a traffic marking paint. It is important to minimize the time for vehicles to drive over the paint without smearing, smudging or removing the paint.

An alternative to paints has been the use of tapes that employ an adhesive to bond the traffic marking tape to the pavement. See for example Lasch et al, U.S. Pat. No. 5,536,569. However, the adhesive material of these tapes is disadvantageously sensitive to high and low ambient temperatures and other weathering conditions. Further, because they do not readily conform to the numerous imperfections in pavement surface, their full adhesiveness to such surfaces is imperfect. Automobile tires distort these tapes, pulling and even tearing them from the road surface.

Recently, the use of thermoplastic-based compositions have been developed that offer several advantages over the typical traffic paint compositions. For example, see U.S. Pat. Nos. 3,996,645 to Okazaki et al, 4,713,404 to Cavitt, 6,020,073 to Wilson and 6,107,367 to Lazarus et al.

Thermoplastic traffic marking materials are typically applied by melting the composition and then applying the molten composition to the road surface. The temperature of the composition when being applied to the road surface is above 350° F. and, if applied in a thin enough layer, will cool sufficiently rapidly without spreading. These present-day, thin-layer, thermoplastic marking materials suffer from a lack of durability. However, the application of a single stripe of over 0.150 inch to provide enhanced durability but which typically has a tendency to spread during the application process, has been proposed. See U.S. Pat. No. 5,511,896.

It is well known that water does not drain from conventional road marking stripes during wet weather conditions. Because a thin film of water forms on the top of the traffic stripe during such rain event, the retroreflectivity of glass beads (used to enhance visibility of the road marking) is significantly reduced. In fact, in heavy rains, the retroreflectivity is entirely destroyed because of such film of water. In order to provide increased visibility of the road marking stripes, large reflective elements are used that extend above the water film. Further, thicker stripes have been proposed that project above the water film.

A problem also exists with visibility of pavement markings on light colored pavements. This is particularly a problem with white pavement markings on concrete. Because of the lack of contrast in color between the pavement surface and the marking material. A contrast base color marking has been used to improve daytime visibility with preformed tapes such as disclosed in U.S. Pat. No. 5,298,761, for example. However, the positive effect of this application is limited due to the fact that the contrast colored area is limited to a relatively narrow strip on each side of the white marking. there exists no contrast colored area in front of or behind the colored markings. This provides little improvement in daytime visibility.

There have also been attempts to provide contrast markings using black traffic paint as the contrast color base. However, traffic paint markings are very thin, typically between about 5 to about 7 mils. As such, they have very limited durability, e.g., about 6 months or less. This limited durability results in ineffective markings over time or very frequent reapplication of the pavement marking causing unacceptable increases in labor costs and disruption of traffic. The very thin application of traffic paint does not extend the marking stripe sufficiently above the pavement surface to produce a visible stripe during wet weather conditions.

A need exists for pavement marking stripes that have enhanced day time visibility on light colored pavement surfaces and during periods of wet weather.

SUMMARY

The present invention is directed to an improved thermoplastic pavement marking composition system that comprises a pavement surface. A first marking stripe is applied and adheres to the top of the pavement surface. This first marking stripe has a thickness of at least about 40 mils to about 110 mils, and comprises a solidified thermoplastic resin composition. The solidified resin composition comprising a black pigment. A second marking stripe is applied and adheres to the surface of the first marking stripe, the second marking stripe having a thickness of at least 40 mils to about 750 mils. It is narrower than said first marking stripe and comprises a solidified thermoplastic resin composition. The thermoplastic resin composition is comprised of a pigment that visibly contrasts with the first marking stripe. Because of the high contrast in color between the two stripes and the light colored pavement surface, the markings are highly visible in daytime conditions. Additionally, because of the thickness of each of the stripes as well as the combined thickness of the stripes, the marked pavement system is highly visible during periods of rain.

A third marking stripe, narrower than the second marking stripe and identical in color and thickness to the first marking stripe, may be applied to the second marking stripe. Similarly, a forth marking stripe, narrower than the third marking stripe and identical in color and thickness to the second marking stripe, may be applied to the third marking stripe. The stripes may be repeated numerous times.

BRIEF DESCRIPTION OF THE DRAWINGS

The invention will be further explained with reference to the drawings, wherein.

Figure 1:
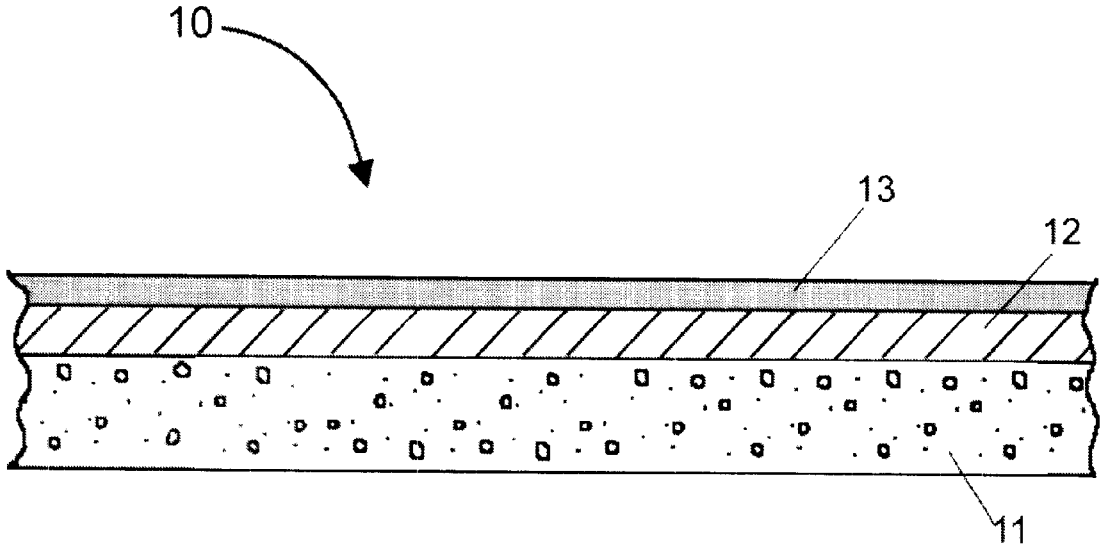
FIG. 1 is a cross section of an illustrative article of the invention.

These figures, which are idealized, are not to scale and are intended to be merely illustrative and non-limiting.

DESCRIPTION OF THE PREFERRED EMBODIMENTS

The present invention provides a system for marking a pavement by applying to the surface of the pavement substantially permanent multiple layers of marking stripes of a thermoplastic resin composition, each stripe (a) having a thickness of at least 40 mils (b) being narrower than the stripe over which it is applied and (c) having a pigment providing a highly visible contrast compared to the stripe over which it is applied.

The thermoplastic resin composition of use in the present invention comprises (a) from about 1 to about 10 weight percent of at least one thermoplastic polymer (b) from about 20 to about 80 weight percent of a nonreinforcing mineral particulate having a particle size of at least 1 $\mu$m (c) from about 1 to about 5 weight percent of a plasticizer (d) a tackifying agent and optionally at least one pigment.

The thermoplastic polymer contained in the thermoplastic resin composition may be chosen from the group consisting of polyolefin polymers, such as illustrated by polyethylene, ethylene copolymers, polypropylene, ethylene-propylene-diene terpolymers polybutylene, polyvinylidene fluoride, polytetrafluoroethylene, ethylene acrylic acid copolymers, ethylene methacrylic acid copolymers, ionically cross-linked ethylene methacrylic acid copolymers, ethylene n-butyl acrylate copolymers, ethylene vinyl acetate copolymers, ethylene methyl acrylate copolymers and ethylene ethyl acrylate copolymers The polyolefin polymers of use in a preferred embodiment of the present invention are those commercially available homopolymers, preferably the substantially linear ones, comprised of the $C_2$ to $C_{20}$ olefins or the interpolymers of ethylene with at least one $C_3$ to $C_{20}$ $\alpha$-olefin and/or $C_2$ to $C_{20}$ acetylenically unsaturated monomer and/or $C_4$ to $C_{18}$ diolefins or such interpolymers in combination with other unsaturated monomers. Such preferred substantially linear olefin polymers include the homopolymers produced from monomers such as of ethylene, propylene, isobutylene, 4-methyl-1-pentene, 1-butene, 1-hexene, 1-octene, etc. as well as the interpolymers of such monomers. Other preferred monomers include styrene, halo or alkyl-substituted styrenes, vinylidene difluoride, tetrafluoroethylene, vinylbenzocyclobutane, 1,4-hexadiene, cyclohexene, and the like.

The term "substantially linear" as applied to the homopolymers and interpolymers of use in the present invention is intended to mean that the polymeric backbone is either unsubstituted or substituted with up to three long-chain branches per 1000 carbon atoms, i.e., up to three alkyl branches that have at least 6 carbon atoms above which the length can not be determined using $^{13}C$ nuclear magnetic resonance spectroscopy. It is preferred that the polymer backbone is substituted with from about 0.01 to 1 long chain branch per 1000 carbon atoms, most preferably from about 0.03 to 1 long chain branch per 1000 carbon atoms.

The homopolymers and/or interpolymers of use in the compositions of present invention are present in the composition at concentrations of from about 1 to about 10 weight percent, preferably from about 1 to about 8 weight percent, most preferably from about 2 to about 5 weight percent.

The homopolymers and/or interpolymers of particular use in practicing the composition of the present invention are described in U.S. Pat. No. 5,272,236 incorporated in its entirety by reference.

The thermoplastic polymer composition of use in the present invention contains from about 1 to about 5 weight percent of a non-volatile, substantially water insoluble plasticizer that is compatible with the other organic materials in the composition. Almost any plasticizer that is typically used in paints or in polymeric compositions is suitable. As an example of such plasticizer is, for example, a modified alkyd resin having a molecular weight from about 500 to about 3000 and a viscosity of not more than 2,000 cps at 20–30° C. Similarly, phthalic acid compounds, i.e., di-n-octyl phthalate, dibutyl phthalate, etc., trimetellitates, i.e., mono-isodecyltrimellitate, tri-isooctyl trimetellitate, etc., alcohol esters and alcohols, i.e., Alfol alcohols such as ALFOL® 610 (mixtures of saturated linear $C_6$, $C_8$ and $C_{10}$ alcohols) and ALFOL® 810 (mixtures of saturated linear $C_8$ and $C_{10}$ alcohols), amides, i.e., toluenesulfonamide, amines and the like are useful as plasticizers herein.

The above plasticizer may be preferably used in the compositions of the present invention in a concentration of from about 1 to about 3 weight percent. In the case of the phthalate, alcohol ester and alcohol plasticizers, they are preferably used at a concentration of from about 1 to about 10 weight percent, most preferably from about 1 to about 3 weight percent. In the case of the trimellitate, amine and amide plasticizers, they are preferably used at a concentration of from about 2 to about 15 weight percent, most preferably from about 2 to about 4 weight percent.

In addition to the thermoplastic polymer and plasticizer components, the composition of the present invention also comprises a nonreinforcing mineral particulate component. Such particulate component may be produced from naturally existing ores or may be prepared synthetically from other raw materials. Examples of the nonreinforcing mineral particulate component of use herein are calcium carbonate, aluminum silicate, i.e., Kaoline, talc, alumina trihydrate, silica, wollastonite, mica, feldspar, barytes, calcium silicate, attapulgite and various hollow beads of synthetic and natural materials, e.g., glass beads.

The preferred nonreinforcing mineral particulate component is calcium carbonate, which is available in five forms: water ground, dry ground, ultra-fine ground, precipitated and surface treated. Of these forms, those prepared by grinding and classifying of high purity limestone having a surface treated with fatty acid-type reagents, such as steric acid, are preferred.

Particulate size of the nonreinforcing mineral particulate component is also an important factor in determining the physical properties of the composition of the present invention. In te case of the preferred nonreinforcing mineral particulate component calcium carbonate, it is commercially available in a mean particulate size (MPS) of less than 1.0 micrometers ($\mu$m) to greater than 20 $\mu$m. Preferably the particle size of the nonreinforcing mineral particulate component of the composition of the present invention is at least 1.0 $\mu$m e.g., from about 1.0 $\mu$m to about 20 $\mu$m, most preferably from about 1.0 $\mu$m to about 3 $\mu$m.

The nonreinforcing mineral particulate component is used in the composition of the present invention at a concentration of from about 20 to about 80 weight percent, preferably from about 30 to about 80 weight percent, most preferably from about 40 to about 70 weight percent.

Tackifiers used in the present invention should be compatible with the polymeric component described earlier, i.e, they are substantially miscible in all proportions. As such, tackifiers of use herein have a ring and ball softening point between about 70° and about 140° C. Illustrative examples of suitable tackifiers include the following types: rosin and rosin derivatives, $C_5$ and $C_9$ hydrocarbon resins and terpines and teripine phenolic derivatives. The tackifiers used in the compositions of the present invention may be used singly or in combination.

The above tackifiers may be preferably used in the compositions of the present invention in a concentration of from about 10 to about 25 weight percent.

The pavement marking composition of the present invention also includes pigments that determine the color of the stripes as applied to the pavement surface and on the top of each other. Such pigments are inorganic or organic, heat-resistant pigments such as titanium dioxide which provides a satisfactory white color to the thermoplastic resin composition used as the second marking stripe in the present invention. As noted above, this stripe is adhered to the top of a first making stripe that is black in color, where the black color may be created by adding carbon black as the pigment for the first marking stripe of the thermoplastic resin composition. Other pigments may also be present and include lead chromate, Prussian blue, ultramarine blue, chrome green, cobalt green and chrome vermillion as well as phthalocyanine and naphthol organic pigments.

In order to achieve the desired effect of having a marking system that is highly visible during daylight hours and in periods of wet weather, it is necessary that multiple layers (alternating black and white layers or stripes) of marking stripes be applied to and adhered on the top of each previous stripe. Preferably, each succeeding layer is narrower than the previous layer and each layer is at least about 40 mils with the first layer being as much as much as 110 mils in thickness, preferably about 50 mils to about 100 mils. The second layer is at least as much as 40 mils and may be as much as 750 mils or more.

It should be noted that the layers do not need to be the same thickness. All that is required is that the combined thickness for two marking stripes (one black stripe and one white marking stripe) is from about 130 mils to about 1,000 mils, preferably about 130 to about 900 mils. Thus, in one embodiment of the present invention, a first marking strip of 40 mils is employed with a second marking stripe of 90 mils being applied on top of such first marking stripe.

FIG. 1 shows a cross section of the an illustrative stripe 10 of the present invention where the first marking stripe 12 can be seen adhered to the top of pavement surface 11. On top of said first marking stripe 12 is a second marking stripe 13. In this illustration, the second marking stripe 13 has a thickness that is less than the first marking stripe 12.

Figure 2:
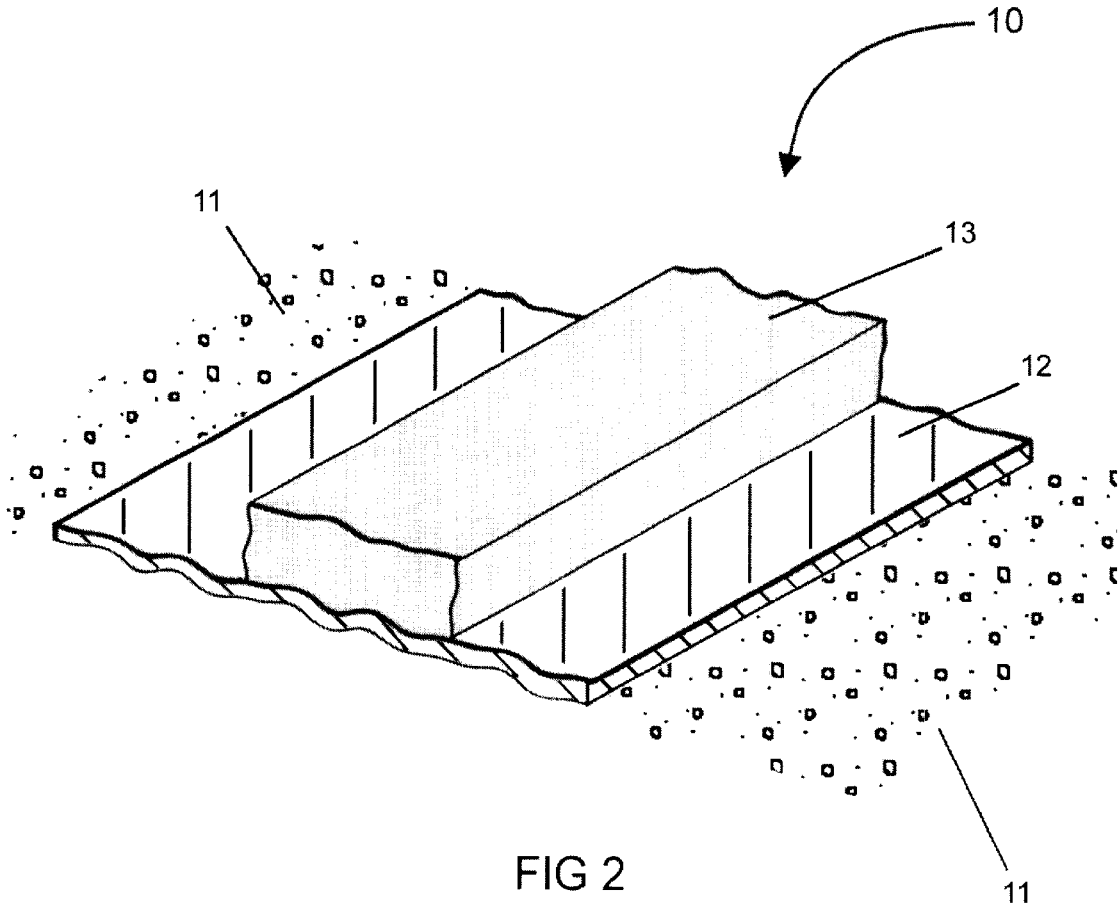
FIG. 2 is a plan view of another illustrative article of the invention.

In FIG. 2, the plane view of an illustrative marking stripe 10 of another embodiment of the present invention is shown. The first marking stripe 12 is shown adhered to the top of pavement surface 11. In this embodiment, the second marking stripe 13 has a greater thickness than does the first marking stripe 12.

Similarly, four layers of black, white, black and white marking stripes (each succeeding stripe narrower than the previous stripe) may be use, each having a minimum thicknesses of 40 mils (or more) each (not to exceed 1,000 mils in total).

One illustrative method of preparing the pavement marking compositions in accordance with the present invention is to add a predetermined amount of the thermoplastic polymer and plasticizer to a beaker and heat the mixture until the components melt together. The remaining components, i.e., the tackifying agent, inert filter, pigment, etc. and optional additives, e.g., glass beads, etc. are than added with stirring, being careful not to exceed 150° C. After approximately 15 minutes of stirring, a well-blended pavement marking composition results. The following Examples represent pavement marking materials in accordance with the present invention prepared in this manner.

The following Examples are included herein to provide greater detail and for illustrative purposes only. They are not intended as a limitation in the scope of the invention.

EXAMPLES

In this Example, the aliphatic C-5 resin is Escorez 1304 manufactured by Exxon Chemical, the pentaerythritol ester of rosin ("Penta Resin" in Table 1) is Sylvatac 105NS supplied by Arizona Chemical, the Polyethylene Wax 1(PE Wax 1") is a low molecular weight, high softening point wax identified as Jenkinol 207L supplied by Acme-Hardesty, the Polyethylene Wax 2 ("PE Wax 2") is a low molecular weight, low softening point wax identified as HP-9055 supplied by Hase Petroleum. The Polyethylene Wax 3 ("PE Wax 3") is an acid modified polyethylene (Epolene C-16 from Eastman Chemical), the Polyethylene Wax 4 ("PE Wax 4") is a low molecular weight polyethylene wax (Epolene C-10 supplied by Eastman Chemical), the Polymer is a copolymer of ethylene and octene-1 from Dow Chemical Company, the Plasticizer is a paraffinic oil (Flexon 845 supplied by Exxon Chemical Company), the Black Pigment is APC 195 Synthetic Black Iron Oxide supplied by Alabama Pigments Company, the Quartz Silica is GS-30 Grade silica sand supplied by U.S. Silica and the Calcium carbonate is Micro White #10 supplied by Emerys Corporation.

TABLE 1

| Reagent | Formulation 15 | Formulation 16 | Formulation 17 | Formulation 21 |
|---|---|---|---|---|
| C-5 Resin | 22.3 | 19.4 | 14.9 | 12.4 |
| Penta Resin | — | 2.5 | 3.4 | 2.5 |
| PE Wax 1 | — | — | — | 0.5 |
| PE Wax 2 | — | — | 3.8 | — |
| PE Wax 3 | — | — | — | 0.4 |
| PE Wax 4 | — | 4 | 2.3 | 0.7 |
| Polymer | 4 | — | — | — |
| Plasticizer | 2.2 | 2.6 | 2.6 | 1.5 |
| Black Pigment | 4 | 4 | 4 | 4 |
| Quartz Silica | 35 | 35 | 35 | 25 |
| $CaCO_3$ | 32.5 | 32.5 | 34 | 53 |

The viscosities of the materials were taken with a Brookfield LVF Viscometer using a #4 spindle. The viscosity tests were performed at 204° C. after initial meltdown. The 4 hour viscosity profiles were also taken with a Brookfield LVF Viscometer after heating the material for 4 hours in a 218°

C. oven, unstirred. The viscosities were at 204° C., 193° C., 177° C. and 166° C.

The color of the materials was taken using a Handycolor colorimeter with illuminant c/2°. The material was poured onto a Teflon coated pan to produce a 2–3 inch diameter, flat patty. The colorimeter was then placed onto the patty and a color measurement was taken.

The hardness was measured by pouring a mold of the thermoplastic with the diameter of the mold being 2 inches and the thickness of the thermoplastic being greater than 0.25 inch. The measurement were taken according to ASTM D2240 utilizing a Shore A Durometer, with the samples and the Durometer being conditioned at 46° C.

The softening points of the samples were determined by the "ring and ball" method according to ASTM E28, after 4 about heating in a 218° C. oven.

TABLE 2

| | Formulation 15 | Formulation 16 | Formulation 17 | Formulation 21 |
|---|---|---|---|---|
| Physical Properties Initial Viscosity | | | | |
| 6 RPM | 3000 | 1500 | 2500 | 10500 |
| 12 RPM | 3000 | 2250 | 2000 | 9500 |
| 30 RPM | 2600 | 1500 | 1000 | 8600 |
| 60 RPM | 2150 | 1300 | 850 | 8900 |
| 4 Hour Viscosity - See 4 Hour Viscosity Profile (Table 4) | | | | |
| Initial Color | | | | |
| L | 7.39 | 7.41 | 11.36 | 8.65 |
| a | 0.58 | 0.42 | 0.31 | 0.44 |
| b | 1.26 | 1.06 | 0.61 | 0.51 |
| Y | 0.55 | 0.55 | 1.29 | 0.75 |
| x | 0.351 | 0.343 | 0.323 | 0.326 |
| y | 0.343 | 0.339 | 0.324 | 0.324 |
| Y1 | — | — | — | — |
| Lab' Delta E | 7.51 | 7.49 | 11.29 | 8.67 |

TABLE 3

| | | | | |
|---|---|---|---|---|
| 4 Hour Color | | | | |
| L | 7.36 | 7.88 | 11.42 | 9.2 |
| a | 0.24 | 0.13 | 0.23 | 0.29 |
| b | 0.88 | 0.65 | 0.27 | 0.55 |
| Y | 0.54 | 0.62 | 1.3 | 0.85 |
| x | 0.335 | 0.327 | 0.317 | 0.324 |
| y | 0.336 | 0.330 | 0.319 | 0.325 |
| Y1 | — | — | — | — |
| Lab' Delta E | 7.41 | 7.89 | 11.32 | 9.78 |
| Hardness | | | | |
| Initial | 25 | 19 | 22 | 74 |
| 4 Hour | 36 | 36 | 37 | 73 |
| Softening Point | | | | |
| 4 Hour (° F.) | 180 | 192 | 226 | 238 |

TABLE 4

| | Formulation 15 | Formulation 16 | Formulation 17 | Formulation 21 |
|---|---|---|---|---|
| 400° F. | | | | |
| 6 | 4000 | 1000 | 1000 | 9000 |
| 12 | 2750 | 1500 | 750 | 7500 |

TABLE 4-continued

| | Formulation 15 | Formulation 16 | Formulation 17 | Formulation 21 |
|---|---|---|---|---|
| 30 | 2100 | 1400 | 1000 | 7800 |
| 60 | 1800 | 1300 | 850 | 7550 |
| 380° F. | | | | |
| 6 | 4500 | 2000 | 1000 | 11500 |
| 12 | 3000 | 2750 | 1000 | 10500 |
| 30 | 2800 | 1800 | 1100 | 10400 |
| 60 | 2800 | 2000 | 1050 | o/s |
| 350° F. | | | | |
| 6 | 9000 | 2500 | 2000 | 22500 |
| 12 | 6250 | 3000 | 1500 | 20500 |
| 30 | 5000 | 3000 | 1500 | 19800 |
| 60 | 4500 | 3000 | 1600 | o/s |
| 330° F. | | | | |
| 6 | 12500 | 6000 | 2000 | 29500 |
| 12 | 9750 | 4250 | 2000 | 28500 |
| 30 | 7500 | 4200 | 2300 | o/s |
| 60 | 6800 | 4250 | 2050 | o/s |

The Taber Abrasion Test was performed using the guidelines of ASTM D4060. The samples were prepared by pouring a layer of the thermoplastic composition on a metal Taber plate and allowing the material to cool. The ambient temperature tests were performed after allowing the material to stabilize for 24 hours at 24° C., while the low temperature samples were conditioned for 24 hours at −12° C. The samples were placed on a Taber Abrasion machine and rotated for 200 cycles using a 500 gram weight on each arm and H-22 Taber Abradors. The sample weight was documented before and after testing and the results were recorded in grams of weight loss.

The box abrasion test was performed by casting a block of thermoplastic 4⅜ inches by 4⅜ inches by ½ inch thick. The ambient temperature tests were performed after allowing the material to stabilize for 24 hours at 24° C., while the low temperature samples were conditioned for 24 hours at −12° C. The block is then placed in a blasting box. 400 Grams of glass shot beads are then blasted into the thermoplastic composition at 22 psi. The thermoplastic block is weighed before and after each blasting and the weight loss recorded. The material is blasted twice on both the front and the back side and an average is taken.

The Izod Impact Test is performed under the guidelines of ASTM D256 by first casting the material in a notched thermoplastic mold. The ambient temperature tests were performed after allowing the material to stabilize for 24 hours at 24° C., while the low temperature samples were conditioned for 24 hours at −12° C. The thermoplastic composition is then subjected to sudden deformation by being struck with a pendulum, which measures the amount of force required to break the mold.

The Gardner Impact Test was performed under the guidelines of ASTM 2794 to determine the resistance of the thermoplastic composition to cracking or de-bonding when exposed to sudden deformation. The test is performed by applying a two inch wide, 120 mil thick stripe to a standard Portland cement block. The ambient temperature tests were performed after allowing the material to stabilize for 24 hours at 24° C., while the low temperature samples were conditioned for 24 hours at −12° C. The sample block is then placed on the Gardner Impact Tester and a weight dropped on the sample. The sample is then checked for cracks and adhesion loss. Any cracks or adhesion loss is considered a failure.

The Bond Strength was tested using the general guidelines of ASTM D4806-88. The material was applied to an unprimed, sandblasted Portland cement concrete block at a thickness of 0.25 inch and at a temperature of 212±2° C. The test samples were conditioned using freeze/thaw conditioning before testing. This consisted of 5 conditioning cycles with the first cycle consisting of 16 hours of freeze cycle at 10° F. and a one hour thaw cycle at room temperature. The next two cycles consisted of a three hour freeze cycle at 10° F. and one hour thaw cycle at room temperature. The next cycle consisted of a 16 hour freeze cycle at 10° F. and a one hour thaw cycle at room temperature. The last cycle consisted of a 3 hour freeze cycle at 10° F. followed by thawing prior to testing. Initial sample preparation and the thaw cycles consisted of placing the test block in water at ambient temperature such that the top surface of the block was about 0.25 inch above the water surface for one hour. The freeze cycles were conducted by removing the sample from the water bath and placing it directly into the cold compartment maintained at 10° F. The results are shown in Table 5.

TABLE 5

| Extended Physical Tests | Formulation 15 | Formulation 16 | Formulation 17 | Formulation 21 |
|---|---|---|---|---|
| Tabor Abrasion (grams loss) | | | | |
| Ambient Temp. | 0.14 | 0.14 | 0.20 | 0.16 |
| Low Temp. | 0.06 | 0.22 | 0.30 | 0.18 |
| Box Abrasion (grams loss) | | | | |
| Avg. Ambient | 0.08 | 1.35 | 2.30 | 3.00 |
| Avg. Low Temp. | 0.95 | 6.18 | 5.77 | 5.60 |
| Izod Impact inch pounds) | | | | |
| Ambient Temp. | 14.67 | 10.92 | 11.17 | 13.70 |
| Low Temp. | 13.56 | 11.17 | 10.83 | 12.90 |
| Gardner Impact in. lbs passed | | | | |
| Ambient Temp. | 160 | 80 | 100 | 40 |
| Low Temp. | 80 | 80 | 60 | 40 |
| Bond Strength (psi) | | | | |
| Ambient Temp. | — | — | — | — |
| Freeze/Thaw | 400 | 402 | 542 | 273 |

As noted in the Background Of The Invention, herein preformed pavement marking tapes are also useful in pavement marking systems. However, there are no preformed tapes that have the combined thickness of the marking stripes of use in the present invention, i.e., from about 130 mils to about 220 mils). The specifications of such tapes require a thickness of from about 60 to about 90 mils. One such preformed tape, illustrative of the group of preformed tapes of particular use in traffic contrast markings is 3M STAMARK® Series 380I-5. It has the following bond strength:

Tensile Bond Strength (using ASTM D-4806-88 as a guide)

Application of the tape to concrete without primer with room temperature conditioning

TABLE 6

| Tensile Bond Strength | |
|---|---|
| Sample Number | Tensile Bond Strength (psi) |
| 1 | 45 |
| 2 | 54 |
| 3 | 60 |
| 4 | 49 |
| 5 | 41 |
| 6 | 54 |

As can be seen, the tensile bond strength of the tapes is approximately 20 times less than displayed by the compositions of the present invention. Clearly, the preformed tapes display inferior physical properties when compared to those of the instant invention.

We claim:

1. A marked pavement system comprising (a) a pavement surface (b) a first marking stripe adhered to the top of the pavement surface, said first marking stripe having a thickness of at least about 40 mils to about 110 mils, said first marking stripe comprised of a solidified thermoplastic resin composition said composition comprising a black pigment and (c) a second marking stripe adhered to the surface of said first marking stripe said second marking stripe having a thickness of at least 40 mils to about 750 mils, being narrower than said first marking stripe and comprised of a solidified thermoplastic resin composition said composition comprising a pigment that visibly contrasts with the first marking stripe, wherein the marked pavement system is highly visible during the daylight hours and during periods of rain.

2. The marked pavement system according to claim 1 wherein the combined thickness of the first marking stripe and the second marking stripe is from about 130 mils to about 900 mils.

3. The marked pavement system according to claim 1 wherein the combined thickness of the first marking stripe and the second marking stripe is from about 130 mils to about 1,000 mils.

4. The marked pavement system according to claim 1 wherein the thickness of the first marking stripe is 40 mils and the thickness of the second marking stripe is about 90 mils.

5. The marked pavement system according to claim 1 wherein the solidified thermoplastic resin composition comprising a black pigment additionally comprises from about 1 to about 10 weight percent of a thermoplastic polymer (b) from about 20 to about 80 weight percent of a nonreinforcing mineral particulate having a particle size of at least 1 $\mu$m (c) from about 1 to about 5 weight percent of a plasticizer and (d) a tackifying agent.

6. The marked pavement system according to claim 1 wherein the solidified thermoplastic resin composition comprising a black pigment additionally comprises from about 1 to about 10 weight percent of a polyethylene homopolymer or interpolymer (b) from about 20 to about 80 weight percent of a nonreinforcing mineral particulate having a particle size of at least 1 $\mu$m (c) from about 1 to about 5 weight percent of a water insoluble plasticizer and (d) a tackifying agent.

7. The marked pavement system according to claim 6 wherein the solidified thermoplastic resin composition comprising a black pigment additionally comprises from about 1 to about 8 weight percent of a polyethylene homopolymer or interpolymer (b) from about 30 to about 80 weight percent of a nonreinforcing mineral particulate having a particle size of at least 1 $\mu$m and (c) from about 1 to about 3 weight percent of a water insoluble plasticizer.

8. The marked pavement system according to claim 6 wherein the polyethylene homopolymer or interpolymer comprises a substantially linear $C_2$ to $C_{20}$ olefin, an interpolymer of ethylene with at least one $C_3$ to $C_{20}$ $\alpha$-olefin and/or a $C_2$ to $C_{20}$ acetylenically unsaturated monomer and/or a $C_4$ to $C_{18}$ diolefin, an interpolymer of said $\alpha$-olefin, said acetylenically unsaturated monomer or said diolefin, said homopolymer or said interpolymer being combined with one or more unsaturated monomers.

9. The marked pavement system according to claim 1 wherein the solidified thermoplastic resin composition comprising a pigment that visibly contrasts with the first marking stripe, additionally comprises from about 1 to about 10 weight percent of a thermoplastic polymer (b) from about 20 to about 80 weight percent of a nonreinforcing mineral particulate having a particle size of at least 1 $\mu$m (c) from about 1 to about 5 weight percent of a plasticizer and (d) a tackifying agent.

10. The marked pavement system according to claim 1 wherein the solidified thermoplastic resin composition comprising a pigment that visibly contrasts with the first marking stripe additionally comprises from about 1 to about 10 weight percent of a polyethylene homopolymer or interpolymer (b) from about 20 to about 80 weight percent of a nonreinforcing mineral particulate having a particle size of at least 1 $\mu$m (c) from about 1 to about 5 weight percent of a water insoluble plasticizer and (d) a tackifying agent.

11. The marked pavement system according to claim 10 wherein the solidified thermoplastic resin composition comprising a pigment that visibly contrasts with the first marking stripe additionally comprises from about 1 to about 8 weight percent of a polyethylene homopolymer or interpolymer (b) from about 30 to about 80 weight percent of a nonreinforcing mineral particulate having a particle size of at least 1 $\mu$m and (c) from about 1 to about 3 weight percent of a water insoluble plasticizer.

12. The marked pavement system according to claim 11 wherein the polyethylene homopolymer or interpolymer comprises a substantially linear $C_2$ to $C_{20}$ olefin, an interpolymer of ethylene with at least one $C_3$ to $C_{20}$ $\alpha$-olefin and/or a $C_2$ to $C_{20}$ acetylenically unsaturated monomer and/or a $C_4$ to $C_{18}$ diolefin, an interpolymer an interpolymer of said $\alpha$-olefin, said acetylenically unsaturated monomer or said diolefin, said homopolymer or said interpolymer being combined with one or more unsaturated monomers.

13. A marked pavement system comprising (a) a pavement surface (b) a first marking stripe adhered to the top of the pavement surface, said first marking stripe comprised of a solidified thermoplastic resin composition said composition comprising a black pigment, from about 1 to about 10 weight percent of a thermoplastic polymer, from about 20 to about 80 weight percent of a nonreinforcing mineral particulate having a particle size of at least 1 $\mu$m, from about 1 to about 5 weight percent of a plasticizer and a tackifying agent (c) a second marking stripe adhered to the surface of said first marking stripe said second marking stripe being narrower than said first marking stripe and comprised of a solidified thermoplastic resin composition said composition comprising a pigment that visibly contrasts with the first marking stripe, from about 1 to about 10 weight percent of a thermoplastic polymer, from about 20 to about 80 weight percent of a nonreinforcing mineral particulate having a particle size of at least 1 $\mu$m, from about 1 to about 5 weight percent of a plasticizer and a tackifying agent, wherein the thickness of the first marking stripe is about 40 mils and the thickness of the second marking stripe is about 90 mils and wherein the marked pavement system is highly visible during the daylight hours and during periods of rain.

* * * * *